US007325751B2

(12) United States Patent
Thome et al.

(10) Patent No.: US 7,325,751 B2
(45) Date of Patent: Feb. 5, 2008

(54) EXHAUST DUCT FOR A ROTARY SPRAYER HAVING A PNEUMATIC TURBINE

(75) Inventors: Caryl Thome, Saint Egreve (FR); Patrick Ballu, Reims (FR)

(73) Assignee: Sames Technologies, Meylan (FR)

( * ) Notice: Subject to any disclaimer, the term of this patent is extended or adjusted under 35 U.S.C. 154(b) by 79 days.

(21) Appl. No.: 10/576,323

(22) PCT Filed: Oct. 19, 2004

(86) PCT No.: PCT/FR2004/002674

§ 371 (c)(1),
(2), (4) Date: Apr. 19, 2006

(87) PCT Pub. No.: WO2005/039782

PCT Pub. Date: May 6, 2005

(65) Prior Publication Data

US 2007/0029405 A1 Feb. 8, 2007

(30) Foreign Application Priority Data

Oct. 20, 2003 (FR) ..... 03 12243

(51) Int. Cl.
*B05B 3/10* (2006.01)

(52) U.S. Cl. ..... 239/224; 239/124; 239/135; 239/139; 239/223; 239/397.5

(58) Field of Classification Search ..... 239/124, 239/125, 127, 128, 135, 139, 222.11, 223, 239/224, 397.5, 701, 703; 118/300, 302
See application file for complete search history.

(56) References Cited

U.S. PATENT DOCUMENTS 4,275,838 A * 6/1981 Fangmeyer ..... 239/223
4,580,597 A * 4/1986 Cordingley et al. ..... 239/224
4,887,770 A * 12/1989 Wacker et al. ..... 239/224
4,997,130 A * 3/1991 Weinstein ..... 239/224
5,133,499 A 7/1992 Schneider
6,050,499 A * 4/2000 Takayama et al. ..... 239/223
6,328,224 B1 * 12/2001 Alexander ..... 239/223
6,972,052 B2 * 12/2005 Krumma et al. ..... 118/300
7,055,768 B1 * 6/2006 Stratton et al. ..... 239/223

FOREIGN PATENT DOCUMENTS

EP 0 780 159 A1 6/1997
FR 2 336 181 A 7/1977
JP 9-262509 A 10/1997

* cited by examiner

*Primary Examiner*—Steven J. Ganey
(74) *Attorney, Agent, or Firm*—Browdy and Neimark, PLLC

(57) ABSTRACT

The invention relates to a sprayer (1), comprising a pneumatic turbine (5), capable of rotating a bowl (6), the turbine being connected to a pressurized gas supply line (11), for driving said turbine and to a drive gas exhaust line (12). The exhaust line (12) is equipped with an inner sleeve (13) which defines the exhaust gas flow volume (V13), an annular gap (E) with a non-zero thickness being provided between the outer surface of the sleeve (13) and the inner surface of the line (12). The structure is compatible with a temperature gradient between the optionally low-temperature exhaust gas flow volume (V13) and the material (2) which forms the exhaust line (12), the risk of condensation being thus limited.

10 Claims, 3 Drawing Sheets

EXHAUST DUCT FOR A ROTARY SPRAYER HAVING A PNEUMATIC TURBINE

The invention relates to a rotary sprayer for spraying a coating product, and to an installation for spraying a coating product and including such a sprayer.

In the field of spraying a coating product that may be in liquid or powder form, it is known to make use of an air turbine for spinning a rotary spray member commonly referred to as a "bowl" or "cup". The turbine is driven by a flow of gas under pressure, usually air, which, on expanding in the vicinity of the blades of a turbine rotor, serves to drive the rotor in rotation together with the spray member it carries. After driving the rotor, the drive air is exhausted to the outside of the sprayer via an exhaust duct that is generally directed towards the rear of the sprayer so as to avoid interfering with the cloud of coating product that is being sprayed.

Because of the expansion to which it is subjected, the temperature of the drive air drops to reach a value that is relatively low, in particular lying in the range 10° C. to −15° C., which is well below the dew point of the air that is usually to be found in coating product spray cabins, where the dew point is usually close to 12° C. when humidity is about 65% and ambient temperature is about 22° C. This results in a risk of ambient air condensing in the vicinity of the exhaust duct. This applies in particular when the exhaust duct passes through a solid body, but also when the duct is formed by a tube that is situated inside a casing of relatively small wall thickness.

Under all circumstances, any condensation of ambient air in the vicinity of the exhaust duct can lead to droplets forming on the outside surface of the sprayer close to the exhaust duct, with an accumulation of such droplets leading to a runaway phenomenon since the portion of the sprayer on which the droplets form becomes more attractive for forming new droplets. This results in a risk of droplets of water and/or product accumulating on the body of the sprayer, which can lead in turn to flows that reach the articles that are being coated, with this applying most particularly to sprayers mounted on multiple-axis type robots, roof machines, or reciprocators. This phenomenon of droplets accumulating locally can also lead to random breaks in the insulation of the sprayer, particularly in the event of variations over time in the high voltage of the electrostatic charge when the sprayer is of an electrostatic type.

To mitigate those drawbacks, it is known to heat the air for driving the rotor of a turbine of a rotary sprayer by means of a heater. But that is expensive and is found in practice to be relatively ineffective if the heater is located at a distance from the turbine, whereas if the heater is installed close to the turbine, it needs to comply with severe safety standards insofar as it is then situated in a zone containing an explosive atmosphere. Furthermore, such an air heater consumes energy, thereby correspondingly increasing the cost of operating an installation that includes such a sprayer.

The invention seeks more particularly to remedy those drawbacks by proposing a novel rotary sprayer for spraying a coating product, in which the risk of condensation in the vicinity of the drive gas exhaust duct is greatly reduced, or even eliminated.

To this end, the invention relates to a rotary sprayer for spraying a coating product, the sprayer comprising a pneumatic turbine suitable for rotating a rotary spray member, said turbine being connected to a duct for feeding gas under pressure to drive the turbine, and being connected to at least one drive gas exhaust duct. The sprayer is characterized in that said exhaust duct includes at least two walls, a first wall being situated generally inside a second wall and defining the exhaust gas flow volume inside said duct, whereas at least one space of non-zero thickness is provided between the outside surface of the first wall and the inside surface of the second wall.

Thanks to the invention, a sheet of gas is established between the two walls of the duct, thereby thermally insulating the inside volume in which the exhaust gas flows from the outside of the exhaust duct, thus avoiding any risk of condensation in the vicinity of said duct.

According to advantageous but non-essential aspects of the invention, a rotary sprayer may incorporate one or more of the following characteristics taken in any technically feasible combination:

The first wall is formed by a sleeve extending over substantially the entire length of the duct, inside the duct.

The above-mentioned space is insulated from the outside and filled with a quantity of gas forming a thermal insulation layer between said sleeve and the material defining the duct.

The above-mentioned space is fed with gas and is connected to a gas outlet, in such a manner that a flow of gas can take place in the space. Under such circumstances, the space is fed with gas under pressure at a pressure greater than the pressure of the exhaust gas, while at least one channel connects said space to the exhaust gas flow volume defined by the first wall. This makes it possible to establish a flow of air in the space in question leading to the exhaust gas flow volume, whereby the gas flowing in said space and the exhaust gas become mixed to produce a mixture at a temperature that can be higher than the temperature of the exhaust gas on its own, thereby also limiting any risk of condensation in the vicinity of the exhaust duct. Advantageously, the above-mentioned channel is formed in an upstream portion of the first wall. In a variant of the invention, the above-mentioned space may be isolated against fluid flow relative to said exhaust gas flow volume.

The above-mentioned gas feeding said annular space is selected from the drive gas, the gas from the bearing of the turbine, or the gas feeding a device for measuring the speed of rotation of the turbine, in particular a measurement device using a microphone.

The first wall is made of a material that is a poor conductor of heat and/or electricity, and in particular a synthetic material, preferably a material of pale color so as to limit heat transfer by radiation.

The invention also relates to an installation for spraying a coating product that includes at least one sprayer as defined above. Such an installation is easier to install and less expensive to operate than are known installations.

The invention can be better understood and other advantages thereof appear more clearly in the light of the following description of two embodiments of a sprayer applying the principle of the invention, given purely by way of example and made with reference to the accompanying drawings, in which.

Figure 1:
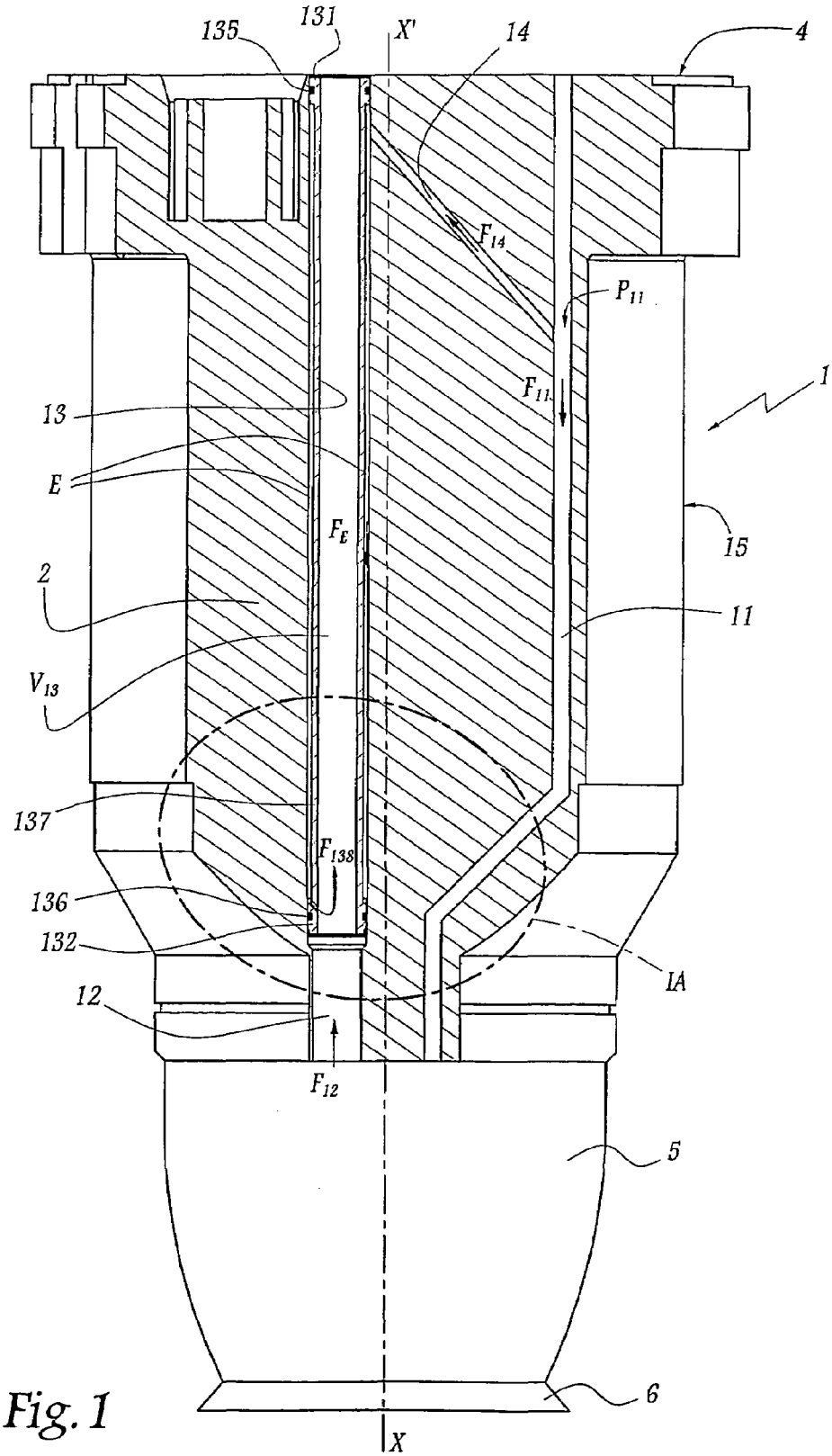
FIG. 1 is a fragmentary schematic section of a sprayer constituting a first embodiment of the invention.
Figure 1A:
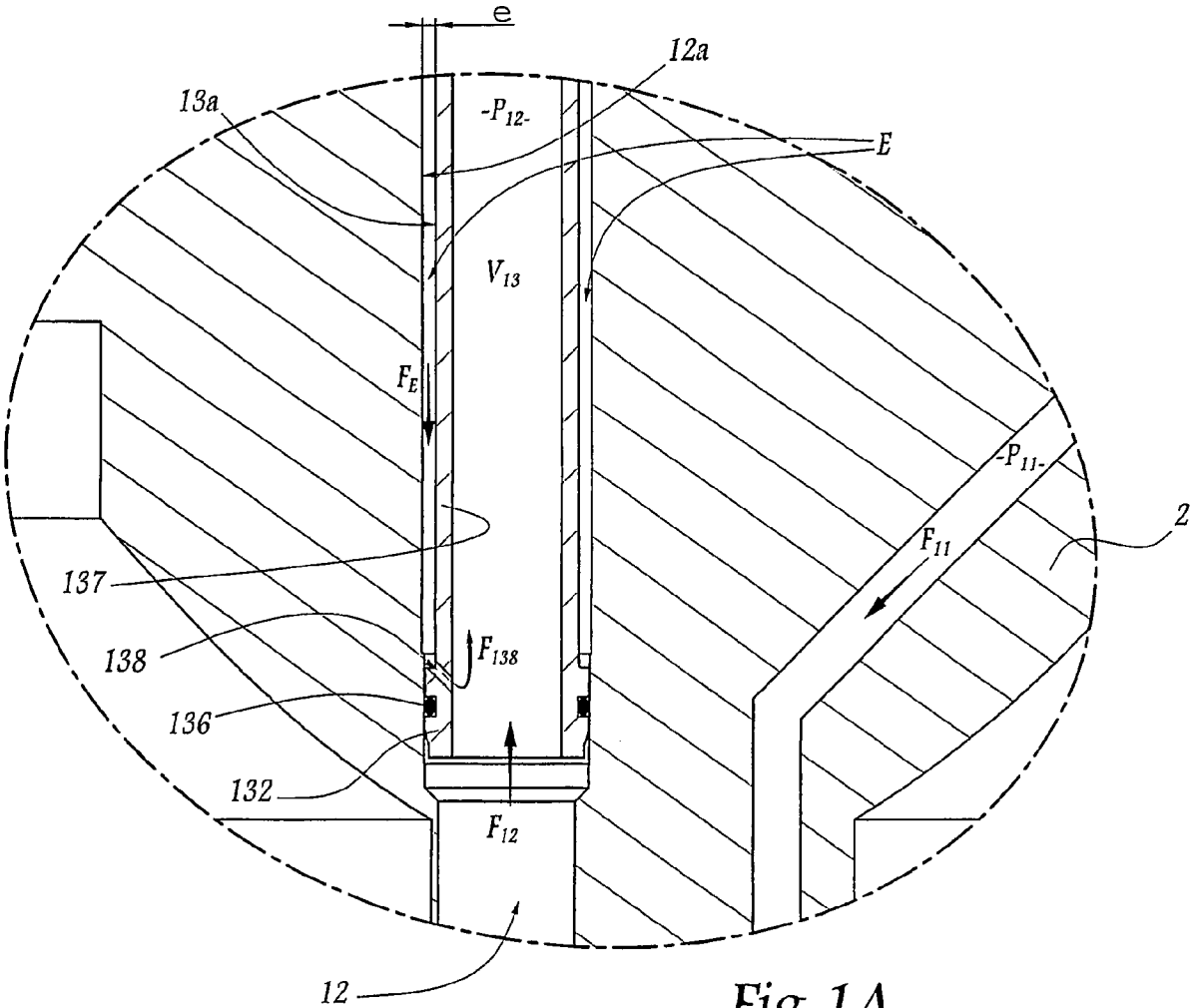
FIG. 1A is a view on a larger scale showing detail A of FIG. 1.
Figure 2:
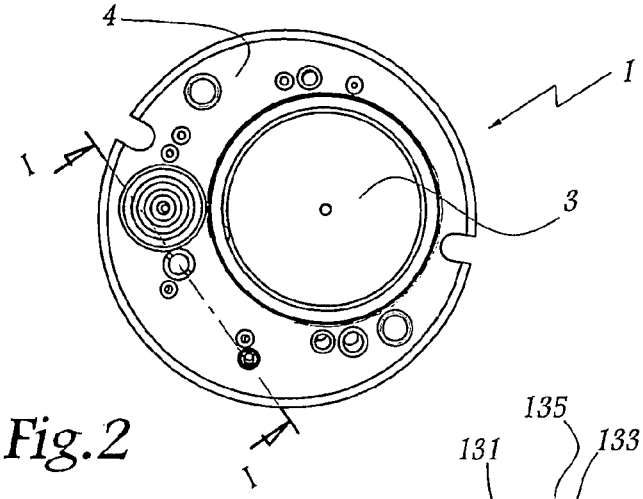
FIG. 2 is a plan view on a smaller scale showing the FIG. 1 sprayer and serving to show its plane for connection to the wrist of a multiple-axis robot, with the section plane of FIG. 1 being represented thereon by line I-I.

The sprayer 1 shown in FIGS. 1 and 2 comprises a body 2 made of an insulating plastics material, in which there is formed a tank 3 for a coating product. The body 2 is for mounting on the wrist of a multiple-axis robot (not shown), in accordance with the technical teaching of EP-A-0 274 322.

In a variant, the body 2 could be designed for mounting on a beam of a roof machine, on a reciprocator, or on any type of robot capable of moving relative to articles that are to be coated.

Opposite from its connection plane 4, the body 2 has an air turbine 5 mounted thereon, shown in outside view only, and designed to spin a bowl 6 about an axis X-X' in order to spray the liquid coating product coming from the tank 3.

A duct 11 passes right through the body 2, i.e. from the connection plane 4 as far as the turbine 5, and enables the drive air used for rotating its rotor (not shown) to be conveyed to the turbine. Arrows $F_{11}$ in FIG. 1 represent the flow of drive air going towards the turbine 5.

A second duct 12 is provided for the exhaust air coming from the turbine, and it extends from the vicinity of the turbine to the connection plane 4, with arrows $F_{12}$ representing the flow of exhaust air along the duct 12.

Figure 3:
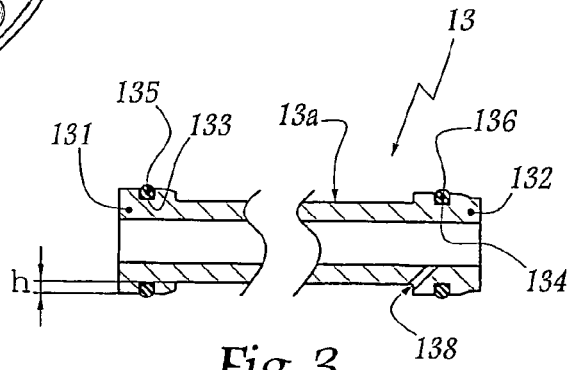
FIG. 3 is a longitudinal section on a larger scale of the insulating sleeve used in the sprayer of FIGS. 1 and 2.

The duct 12 is fitted with a sleeve or liner 13 that can be seen more particularly in FIG. 3 and that is made of a plastics material that is a poor conductor both of heat and of electricity, or that constitutes an insulator. In the example shown, it is constituted by white polyethylene terephthalate. The sleeve 13 extends over the major fraction of the length of the duct 12 and it is provided in the vicinity of each of its ends with a rim of extra thickness 131, 132 having a respective groove 133, 134 formed therein for receiving a respective O-ring 135, 136. The O-ring serves to press against the surface 12*a* defining the duct 12 in the body 1.

Given the radial height h of the rims 131 and 132, they serve to hold the intermediate portion 137 of the sleeve 13 spaced apart from the surface 12*a*. More precisely, because of the presence of the rims 131 and 132, there exists an annular space E of non-zero thickness e that is substantially equal to the height h and that is organized between the radially outer surface 13*a* of the sleeve 13 and the surface 12*a*.

Thus, the duct 12 is double-walled or double-skinned: the sleeve 13 forms its inner wall or skin while the surface 12*a* and the material of the body 2 form its outer wall or skin.

A branch connection 14 is pierced through the body 2 and connects the duct 11 to the space E.

Furthermore, a hole 138 is formed in the rim 132 that is for placing in the portion of the duct 12 that is closest to the turbine 5, i.e. in the upstream portion of the duct.

Given the expansion that takes place within the turbine 5, the relative pressure $P_{12}$ in the duct 12 is of the order of a few hundreds of millibars. The relative pressure $P_{11}$ of the feed that exists in the duct 11 is of the order of 5 bars to 6 bars.

Because of this pressure difference, some of the turbine drive air flows along the branch connection as represented by the arrows $F_{14}$ into the annular space E. From there, the air flows in the space E, as represented by arrows $F_E$, and then through the hole 138 as represented by arrow $F_{138}$ into the inside volume $V_{13}$ of the sleeve 13 along which the exhaust air flows.

In practice, the flow rate of air in the space E is negligible compared with the flow rate in the duct 11. As a result, establishing a sheet of air in the space E is not harmful for proper operation of the turbine 5.

In other words, a sheet of air is created flowing in the space E, thereby thermally insulating the volume $V_{13}$ from the material of the body 2 that forms the second wall of the duct 12. This also makes it possible to raise the temperature of the sleeve 13 relative to that of the exhaust gas insofar as the flow in the space E delivers heat to the material constituting said sleeve.

Thus, even though the exhaust air is at a relatively low temperature, the surface 12*a* of the duct 12 is not taken to a temperature that is too low, and as a result there is no risk of ambient air condensing on the outside surface 15 of the body 1 in the vicinity of the duct 12.

In a variant of the invention that is not shown, a plurality of holes like the hole 138 can be provided in the upstream portion of the sleeve 13, or indeed distributed along the length thereof.

In variants of the invention that are not shown, instead of using the air for driving the turbine in rotation, it is possible to use air from a bearing when the turbine is fitted with an air bearing. It is also possible to use the air for feeding a device that measures the speed of rotation of the turbine by means of a microphone.

Figure 4:
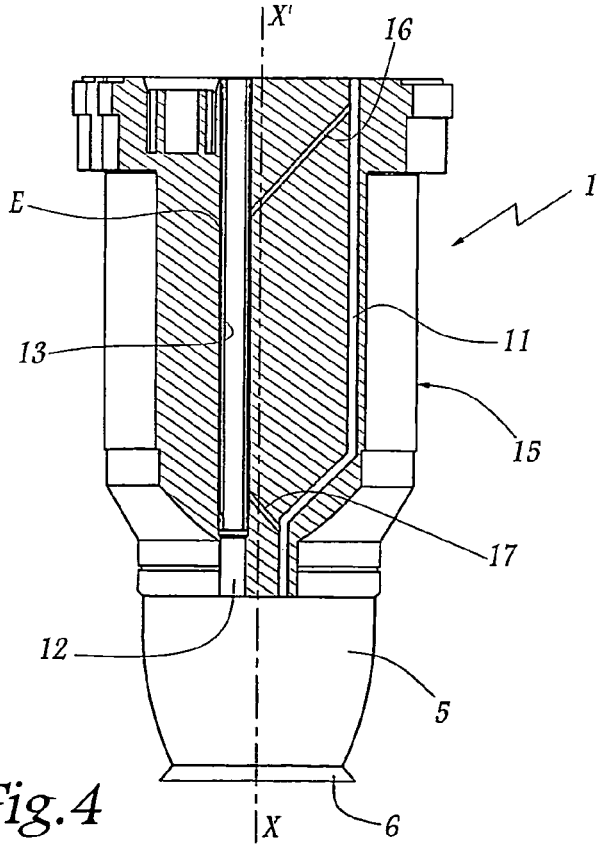
FIG. 4 is a section view analogous to FIG. 1, but on a smaller scale, showing a sprayer constituting a second embodiment of the invention.

In the second embodiment of the invention shown in FIG. 4, elements that are analogous to elements in the first embodiment are given identical references. It is only differences relative to the first embodiment that are explained. This embodiment differs from the preceding embodiment essentially in that the inside volume $V_{13}$ of the sleeve 13 is insulated from the annular space E defined between the sleeve 13 and the surface 12*a* of the duct 12. More precisely, the air passing along the space E and coming from the turbine feed duct 11 penetrates into the space E via an inlet connection 16 and leaves via an outlet connection 17 that leads to the duct 11, thereby making it possible to use the air that has traveled along the space E for feeding the turbine.

This embodiment is more economical than the preceding embodiment insofar as the air used for forming the insulating sheet between the facing surfaces 13*a* and 12*a* of the sleeve 13 and of the duct 12 is not lost but can be reused. However this embodiment is not as effective than the preceding embodiment in terms of its action on the temperature of the exhaust gas, insofar as in the first embodiment the air coming from the space E and that becomes mixed with the exhaust gas is at a temperature that is higher than the gas leaving the turbine, thus leading to a relative increase in the temperature of the mixture of gases traveling along the volume $V_{13}$. Furthermore, it is possible to include in the duct 11 an adjustable valve, e.g. a cone-point setscrew, so as to set the air flow rate in the duct 11 and consequently in the connection 16 and the space E. This makes it possible to adapt the flow in the space E to operating conditions. The flow rate in the duct 11 can be set to a value of zero.

In a variant of the invention that is not shown, all of the drive air flow passes via the space E. In other words, the duct 11 is omitted between the connections 16 and 17. This variant ensures that there is a large flow within the volume E independently of the head losses in its speed and exhaust ducts.

In another variant of the invention that is not shown, the space E defined between the sleeve 13 and the surface 12*a* may be insulated from the outside, i.e. it need not be fed with air coming from a duct connected to the turbine, thereby presenting the advantage of great simplicity. However, the insulation effect obtained is less effective than in the first two embodiments shown.

The invention is also applicable when the walls defining the space E are not parallel circular sections, in which case the space is not annular. In practice, the space may have any shape appropriate for its function. The space E may also be subdivided lengthwise or in its section into a plurality of portions that are in fluid-flow connection or that are independent.

Whatever the embodiment concerned, the space E defined between the sleeve 13 and the inside surface 12*a* of the duct enables a sheet of insulating air to be established that is compatible with a temperature gradient between the inside volume $V_{13}$ of the sleeve and the material constituting the duct 12.

The invention is not limited to sprayers fitted with a turbine having a gas bearing, but applies equally well to sprayers fitted with turbines having ball bearings or roller bearings.

The invention is shown with an exhaust duct made in a solid body 1. Nevertheless, the invention also applies to an exhaust duct formed by a tube disposed inside a thin-walled casing. Under such circumstances, the tube may be lined internally, or externally, or both internally and externally simultaneously, in which case two substantially concentric volumes similar to the volume E are created, each of which can be fed with gas so as to form an insulating sheet. These volumes can be fed in common or independently.

The invention is shown as having an annular space E fed with air. Nevertheless, it is applicable to having an annular space E fed with some other gas, particularly when such an other gas is used for feeding the turbine.

The invention is applicable to electrostatic sprayers and to so-called pneumatic sprayers, i.e. sprayers in which electrostatic phenomena are not used for facilitating the transfer of doublets of coating product towards the article that is to be coated.

The invention claimed is:

1. A rotary sprayer for spraying a coating product, the sprayer comprising a pneumatic turbine suitable for rotating a rotary spray member, said turbine being connected to a duct for feeding gas under pressure to drive the turbine, and being connected to at least one drive gas exhaust duct, the sprayer being characterized in that said exhaust duct includes at least two walls, a first wall (13) being situated generally inside a second wall (2) and defining the exhaust gas flow volume ($V_{13}$) inside said duct (12), whereas at least one space (E) of non-zero thickness (e) is provided between the outside surface (13*a*) of the first wall and the inside surface (12*a*) of the second wall.

2. A sprayer according to claim 1, characterized in that said first wall is formed by a sleeve (13) extending over substantially the entire length of said duct (12), inside the duct.

3. A sprayer according to claim 1, characterized in that said space (E) is insulated from the outside and filled with a quantity of gas forming a thermal insulation layer between said sleeve and the material defining said duct.

4. A sprayer according to claim, characterized in that said space (E) is fed (14; 16) with gas ($F_{14}$) and is connected to a gas outlet (138; 17), in such a manner that a flow of gas ($F_E$) can take place in said space.

5. A sprayer according to claim 4, characterized in that said space (E) is fed with gas under pressure ($F_{14}$) at a pressure ($P_{11}$) greater than the pressure ($P_{12}$) of the exhaust gas, and in that at least one channel (138) connects said space to the exhaust gas flow volume ($V_{13}$) defined by the first wall (13).

6. A sprayer according to claim 5, characterized in that said channel (138) is formed in an upstream portion (132) of the first wall (13).

7. A sprayer according to claim 4, characterized in that said space (E) is isolated against fluid flow relative to said exhaust gas flow volume ($V_{13}$).

8. A sprayer according to claim 4, characterized in that the gas feeding said annular space is selected from the drive gas, the gas from the bearing of the turbine (5), or the gas feeding a device for measuring the speed of rotation of the turbine.

9. A sprayer according to claim 1, characterized in that said first wall (13) is made of a synthetic material that is a poor conductor of heat and/or electricity.

10. An installation for spraying a coating product, the installation being characterized in that it includes at least one sprayer (1) according to claim 1.

* * * * *